US007876181B2

(12) United States Patent
Nakano et al.

(10) Patent No.: US 7,876,181 B2
(45) Date of Patent: Jan. 25, 2011

(54) EARTH LEAKAGE CIRCUIT BREAKER

(75) Inventors: Masaaki Nakano, Saitama (JP); Hisanobu Asano, Saitama (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 44 days.

(21) Appl. No.: 12/000,474

(22) Filed: Dec. 13, 2007

(65) Prior Publication Data

US 2008/0180195 A1 Jul. 31, 2008

(30) Foreign Application Priority Data

Dec. 25, 2006 (JP) ..... 2006-348358

(51) Int. Cl.
*H01H 75/00* (2006.01)
*H01H 77/00* (2006.01)
*H01H 83/00* (2006.01)

(52) U.S. Cl. ..... 335/8; 335/10

(58) Field of Classification Search ..... 335/6, 335/8–10, 220

See application file for complete search history.

(56) References Cited

U.S. PATENT DOCUMENTS 4,013,929 A * 3/1977 Dietz et al. ..... 361/643
4,728,914 A * 3/1988 Morris et al. ..... 335/6
4,786,885 A * 11/1988 Morris et al. ..... 335/202
5,172,293 A * 12/1992 Matsumoto et al. ..... 361/102
5,414,395 A * 5/1995 Garnto et al. ..... 335/18
5,466,903 A * 11/1995 Faber et al. ..... 200/400
5,633,483 A * 5/1997 Oster et al. ..... 200/17 R
5,757,254 A * 5/1998 Kurono et al. ..... 335/35
6,201,460 B1 * 3/2001 Winslett et al. ..... 335/172
6,784,770 B2 * 8/2004 Gimenez et al. ..... 335/18
6,882,257 B2 * 4/2005 Anamura et al. ..... 335/18
7,535,327 B2 * 5/2009 Desilva et al. ..... 335/174
2007/0035367 A1 * 2/2007 Desilva et al. ..... 335/202

FOREIGN PATENT DOCUMENTS

JP U-H03-118536 12/1991
JP H07-085768 3/1995

* cited by examiner

*Primary Examiner*—Elvin G Enad
*Assistant Examiner*—Alexander Talpalatskiy
(74) *Attorney, Agent, or Firm*—Manabu Kanesaka

(57) ABSTRACT

A circuit breaker for overcurrent protection and earth leakage protection includes a main housing, a circuit board, a zero-phase current transformer, an earth leakage detection circuit, a trip coil, a sensitivity current-switch, an action time switch, and an earth leakage test switch. The earth leakage detection circuit, the sensitivity current-switch, the action time switch, and the earth leakage test switch are mounted on the circuit board and installed in the main housing.

4 Claims, 4 Drawing Sheets

EARTH LEAKAGE CIRCUIT BREAKER

BACKGROUND OF THE INVENTION AND RELATED ART STATEMENT

Molded case circuit breakers and earth leakage circuit breakers are known as protective devices in a low voltage distribution system. An earth leakage circuit breaker now manufactured in Japan generally has a construction with components for over current protection function and components for ground-fault protection function in a monolithic main housing. In order to improve the ease of use in the user side, an earth leakage circuit breaker has a common external dimension of the main housing shared by a molded case circuit breaker that has the same ampere frame (AF), and installs the functional components mentioned above in the main housing.

FIG. 5 shows a circuit diagram of an earth leakage circuit breaker, and FIGS. 6 and 7 show a construction of a circuit breaker of prior art. In FIG. 5, the reference numeral 1 designates a three-phase main circuit; the reference numeral 2, an open-close contact of the main circuit 1; the reference numeral 3, a zero-phase current transformer for detecting an earth leakage current with a primary winding of the main circuit 1; the reference numeral 4, an earth leakage detection circuit (an IC) for detecting occurrence of an earth leakage event on the basis of a secondary output from the zero-phase current transformer 3; the reference numeral 5, a power supply circuit for the earth leakage detection circuit 4; the reference numeral 6, a trip coil to open the open-close contact 2 on the basis of an output signal from the earth leakage detection circuit 4 (a plunger type electromagnet combined with an operation slider linking to an open-close mechanism of the circuit breaker); the reference numeral 7, a sensitivity current-switch for variably set a sensitivity current of the earth leakage circuit breaker (a slide switch); the reference numeral 8, an action time switch for variably set an action time (a slide switch); and the reference numeral 9, an earth leakage test switch (a push button switch).

In the construction of the earth leakage circuit breaker shown in FIG. 6, the reference numeral 10 designates a main housing (a lower case) of the earth leakage circuit breaker; the reference numeral 11, terminals at the supply side; the reference numeral 12, terminals at the load side; the reference numeral 13, an open-close operation handle; the reference numeral 14, an open-close mechanism; the reference numeral 15, an arc extinguishing chamber for the main circuit contact 2 (FIG. 5); and the reference numeral 16, an earth leakage trip unit. Here, the zero-phase current transformer 3 shown in FIG. 5 is disposed behind the load side terminals 12. A circuit board (a printed circuit board) mounting an IC of the earth leakage detection circuit 4 is accommodated in a case and disposed beside the zero-phase current transformer 3 in the main housing 10.

The earth leakage trip unit 16, on the other hand, is disposed beside the open-close operation handle 13 and accommodated in the central region of the main housing 10. The earth leakage trip unit 16 is provided with, as shown in FIG. 7, a trip coil 6 and an earth leakage indicating button 17 that acts in response to the trip coil action in the lower portion of a unit case 16*a*, and a sensitivity current-switch 7, an action time switch 8, an earth leakage test switch 9 and a connector 18 in the upper portion of the unit case. In the condition with a cover (not shown) put on the main housing 10, grips of the switches 7, 8, 9, and the earth leakage indicating button 17 are exposing outside the cover through openings formed in the cover.

Lead wires 19 running in the main housing 10 performs electrical connections between the circuit board of the earth leakage detection circuit 4 disposed beside the zero-phase current transformer 3 and the components including the trip coil 6 and the switches 7, 8 of the earth leakage trip unit 16 disposed beside the open-close operation handle 13. (See Patent Document 1: Japanese Utility Model Publication No. H3-118536).

The earth leakage circuit breaker having the conventional structure described above involves the following problems. As shown in FIG. 6, the zero-phase current transformer 3 and the earth leakage trip unit 16 are disposed at separate places in the main housing, and the circuit board of the earth leakage detection circuit 4 that is disposed beside the zero-phase current transformer 3 and the components of the earth leakage trip unit 16 including the trip coil 6, a sensitivity current-switch 7, and action time switch 8, and the earth leakage test switch 9 are connected by a connector 18 and lead wires 19. Moreover, the lead wires 19 thread their way through other components installed in the main housing 10. As a result, the lead wires are vulnerable to adverse affections of external noises, and arc gas and heat generated in the current interruption. Therefore, it is necessary for the lead wires to be protected against the external noises, and the arc gas and heat. In addition, the wiring work of the lead wires 19 takes a lot of time and may cause troubles, and thus, raises the production costs.

It is therefore an object of the present invention to solve the problems stated above and provide an earth leakage circuit breaker with an improved construction of an earth leakage trip unit, thereby reducing the number of components for earth leakage protection function and achieving space-saving and cost reduction of the circuit breaker.

Further objects and advantages of the invention will be apparent from the following description of the invention.

SUMMARY OF THE INVENTION

To accomplish the above object, a circuit breaker according to the present invention installs functional components for overcurrent protection and earth leakage protection in a main housing with a monolithic structure, the functional components for earth leakage protection including a zero-phase current transformer, an earth leakage detection circuit, a trip coil, a sensitivity current-switch, an action time switch, and an earth leakage test switch. The earth leakage detection circuit, the sensitivity current-switch, the action time switch, and the earth leakage test switch are all mounted on a circuit board and installed in the main housing of the circuit breaker (the first aspect of the invention). Specifically, the circuit board is disposed in the main housing of the circuit breaker in such a way as specified in the following.

(1) The circuit board in combination with the trip coil is accommodated in a unit case of an earth leakage trip unit that is disposed beside an open-close operation handle (the second aspect of the invention).

(2) In the earth leakage circuit breaker of (1) above, the earth leakage trip unit comprises a lower case accommodating the trip coil, an upper case accommodating the circuit board and laid on the lower case, and a cover for the upper case, wherein terminals of the circuit board, an end of the upper case and an end of the cover are formed extending to proximity of the zero-phase-current transformer, and terminals of the zero-phase current transformer and the terminals of the circuit board are electrically connected (the third aspect of the invention).

In this construction, all the components of the earth leakage detection circuit (an IC), the sensitivity current-switch and the action time switch for setting a sensitivity current and an action time of the earth leakage circuit breaker, and the earth leakage test switch are mounted and arranged in a sheet of circuit board (a printed circuit board), and connected to each other by a conductor pattern formed on the circuit board. As a result, such lead wires as in the conventional structure shown in FIGS. 6 and 7 have become unnecessary that thread their routes through the interior of the main housing to make connections between the board of the earth leakage detection circuit and those switches that are disposed at separate places in the main housing. Therefore, cost reduction in the product has been achieved by virtue of decrease in the number of components related to the wiring and the man-hour for the wiring work, as well as the saving in space. In addition, the influence of external noises propagating through the lead wires is also reduced.

The circuit board is accommodated in a unit case of the earth leakage trip unit in combination with the trip coil. This construction has simplified installation into the main housing of the circuit breaker and handling of the circuit board and other components, and further, prevented undesired effects of the arc gas and heat generated in the current interruption action, thereby ensuring high reliability.

The earth leakage trip unit comprises a lower case accommodating the trip coil, an upper case accommodating the circuit board and laid on the lower case, and a cover for the upper case. Terminals of the circuit board, an end of the upper case and an end of the cover are extended to proximity of the zero-phase current transformer. Terminals of the zero-phase current transformer and the terminals of the circuit board are electrically connected, which has shorted the distance between the terminals of the zero-phase current transformer and the terminals of the circuit board, and made the short lead wires be still sufficient for connection wiring between the terminals of the zero-phase current transformer and the terminals of the circuit board.

DETAILED DESCRIPTION OF PREFERRED EMBODIMENTS

Figure 1:
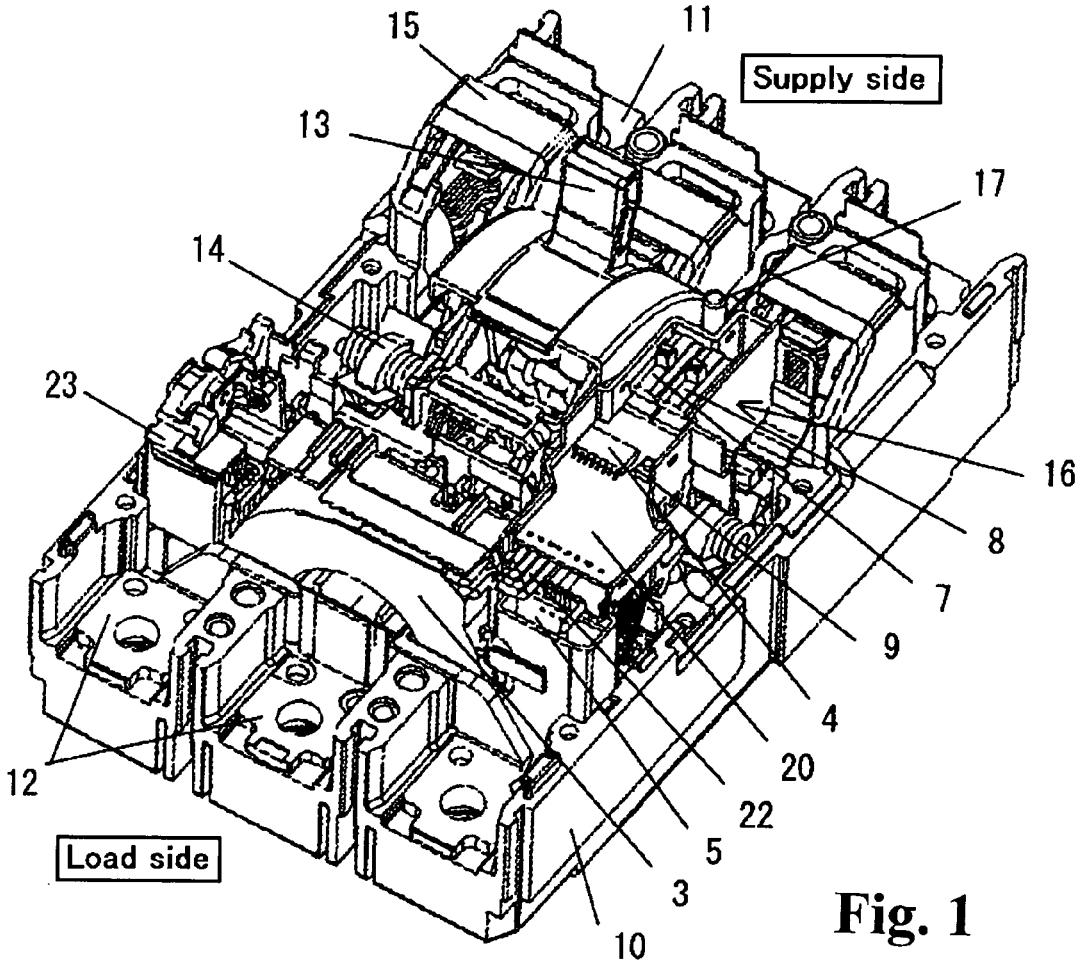
FIG. 1 shows a perspective view of construction of an earth leakage circuit breaker of an embodiment according to the invention, in which a cover of a main housing and a cover of an earth leakage trip unit are removed.
Figure 2:
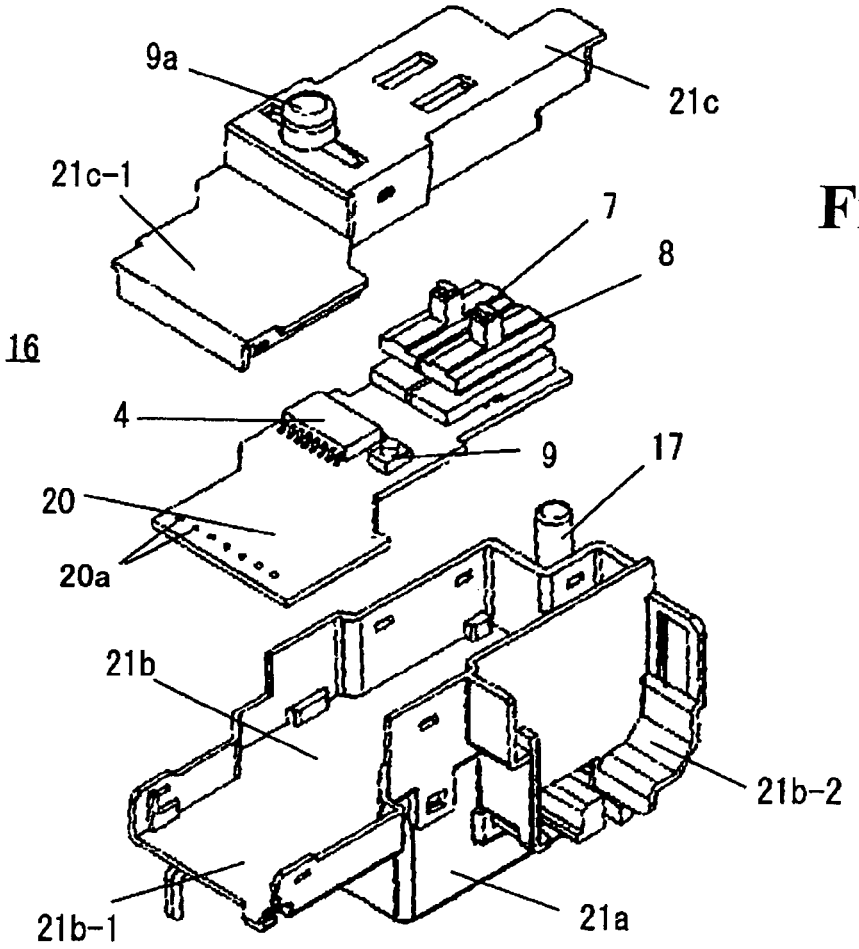
FIG. 2 is an exploded perspective view showing a construction of the earth leakage trip unit in FIG. 1.
Figure 3:
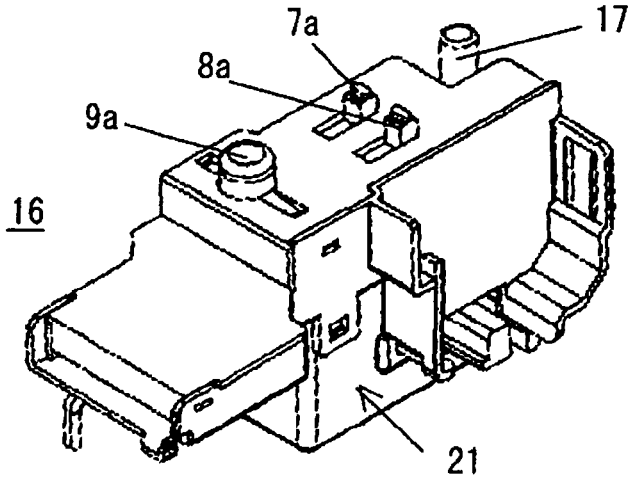
FIG. 3 is a perspective view of the assembled earth leakage trip unit shown in FIG. 2.
Figure 4:
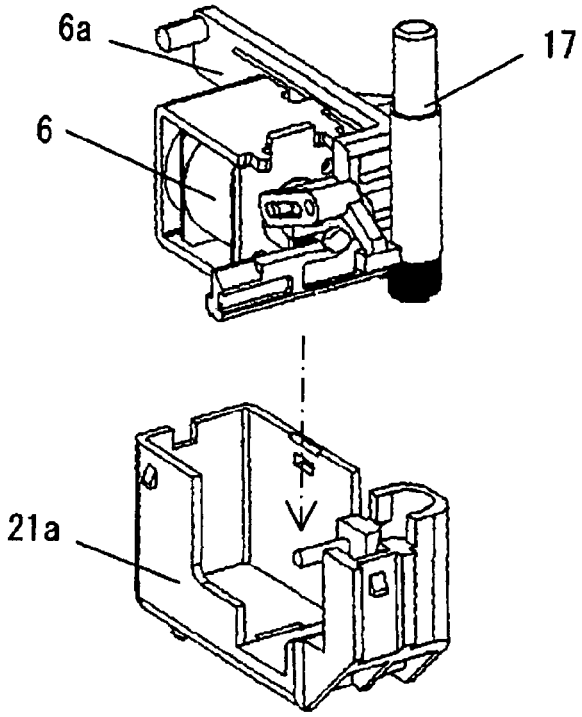
FIG. 4 is a perspective view of a trip coil that is accommodated in the lower case in FIG. 2.

Now, preferred embodiments will be described with reference to FIGS. 1 through 4. Here, FIG. 1 shows an assembled structure of an earth leakage circuit breaker in which the cover of the main-housing and the cover of the earth leakage trip unit are removed. FIG. 2 is an exploded perspective view of the earth leakage trip unit, FIG. 3 is a perspective view of an assembled earth leakage trip unit shown in FIG. 2, and FIG. 4 is an exploded perspective view of a trip coil installed in the earth leakage trip unit. The same members as in FIG. 6 are given the same symbols and description is omitted.

Figure 6:
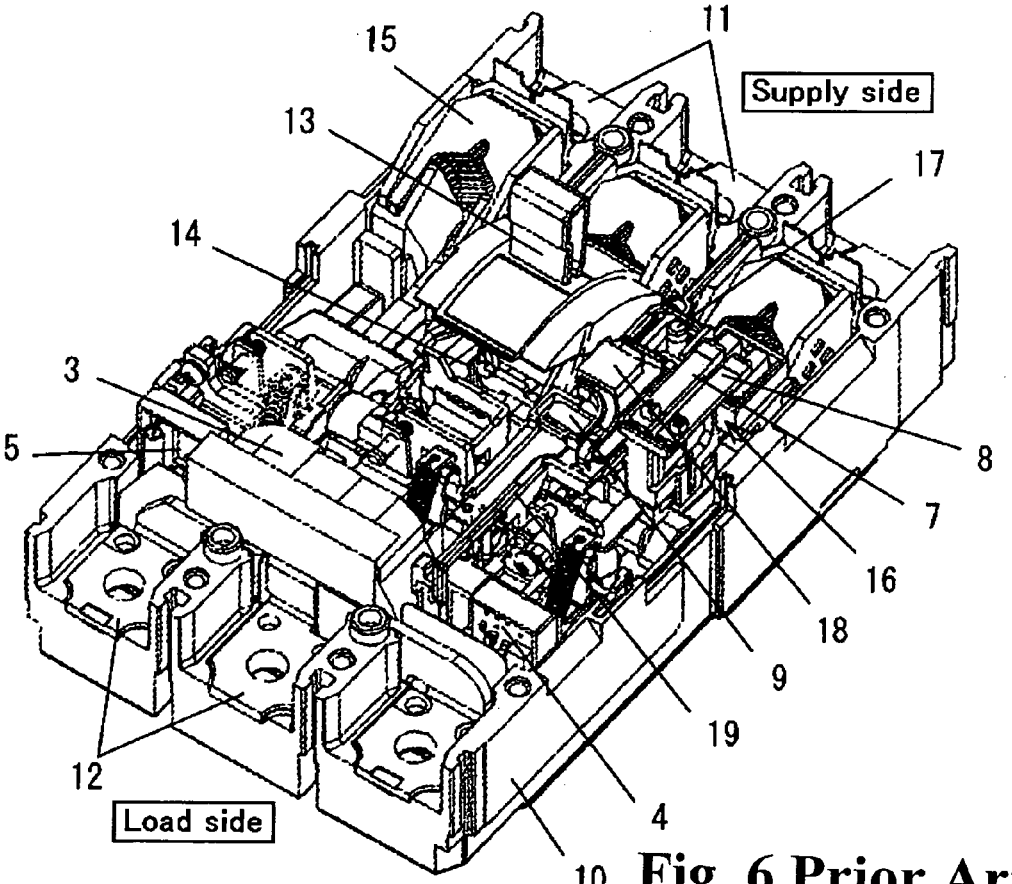
Fig. 6 Prior Art
FIG. 6 shows a perspective view of construction of an earth leakage circuit breaker of prior art, in which a cover of a main housing and a cover of an earth leakage trip unit are removed.
Figure 7:
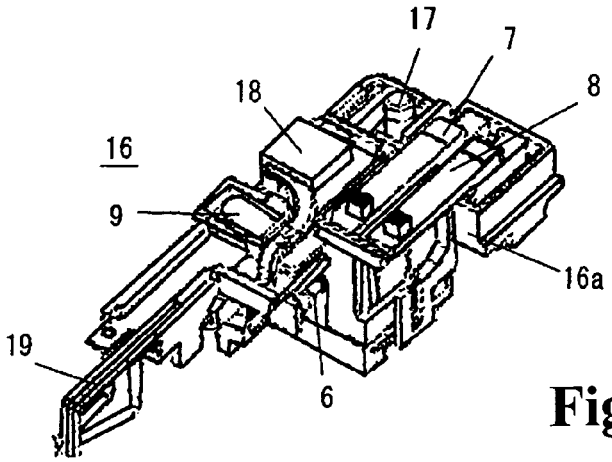
Fig. 7 Prior Art
FIG. 7 is a perspective view showing a construction of the earth leakage trip unit in FIG. 6.

The earth leakage circuit breaker of the embodiment shown in FIGS. 1 through 4 is basically similar to the earth leakage circuit breaker of the prior art shown in FIG. 6. In the construction of FIG. 1, however, the earth leakage trip unit 16 that is disposed beside the open-close operation handle 13 and installed in the main housing 10 has the following structure.

Referring to FIGS. 2 through 4, a unit case 21 of the earth leakage trip unit 16 is a molded resin case composed of three divided portions: a lower case 21*a*, an upper case 21*b* having a shape of a tray and laid on the lower case 21*a*, and a cover 21*c*. The three portions are joined detachably by a snap-fit mechanism.

The lower case 21*a* accommodates, as shown in FIG. 4, a trip coil 6 in combination with an operation slider 6*a* and an earth leakage indicating button 17. The upper case 21*b* accommodates, as shown in FIGS. 2 and 3, a circuit board 20 (a printed circuit board) having a oblong external shape. An end of this upper case 21*b* (the left end in FIGS. 2 and 3) is projecting sideward from the lower case 21*a* matching the external shape of the circuit board 20 and forming an extension 21*b*-1. Corresponding to this extension of the upper case 21*b*, the cover 21*c* also has an extension 21*c*-1.

The circuit board 20 is installed with the sensitivity current-switch 7, the action time switch 8, the earth leakage test switch 9, and the earth leakage detection circuit (an IC) 4 arranged as shown in FIG. 2. These components are soldered to a circuit pattern formed on the circuit board 20 to make a predetermined electric circuit.

In the state the cover 21*c* is put on the upper case 21*b* as shown in FIG. 3, operation grips 7*a*, 8*a* of a slider type sensitivity current-switch 7 and the action time switch 8 are projecting upwards through oblong holes opened in the cover 21*c*. An operation button 9*a* of an earth leakage test switch 9 is attached to the cover 21*c* for manual ON, OFF operation of the earth leakage test switch 9. A pocket-shaped frame 21*b*-2 formed projecting sideway from the upper case 21*b* accommodates an earth leakage detection switch (a micro switch, not shown in the figures), which is linked to a plunger of the trip coil 6 (FIG. 4) and outputs an electric signal indicating an action of the earth leakage circuit breaker upon detection of the earth leakage event.

Figure 5:
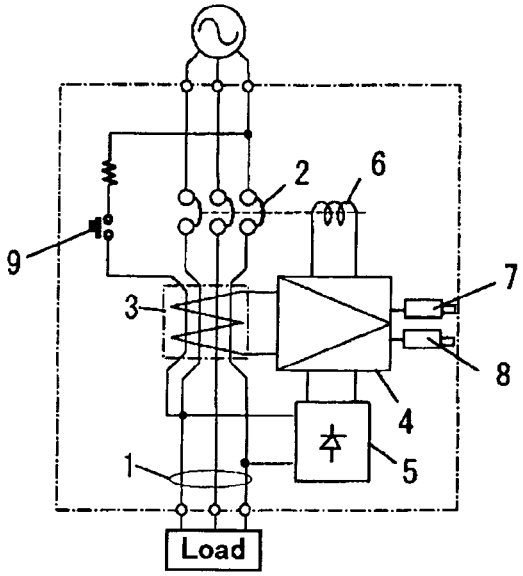
Fig. 5 Prior Art
FIG. 5 is a circuit diagram of an earth leakage circuit breaker.

As shown in FIG. 1, this earth leakage trip unit 16 is inserted from above into a pocket-shaped space formed beside the open-close operation handle 13 in the main housing 10 of the circuit breaker with the unit case 21 being fixed to the main housing 10. In the state of the earth leakage trip unit mounted on the main housing, the tip of the extension 21*b*-1 of the upper case 21*b* accommodating the circuit board 20 is positioned in proximity to the zero-phase current transformer 7 disposed in the load terminal side of the main housing 10 and opposes the output terminals of the current transformer. In this state of the earth leakage trip unit mounted on the main housing, the lead wires 22 drawn out of the terminals 20*a* of the circuit board 20 are connected to the terminals of the zero-phase current transformer 3 and the power supply circuit 5 (FIG. 5) arranged on the right side the zero-phase current transformer 3. Thus, the wiring work at the earth leakage trip unit is completed.

In the earth leakage circuit breaker shown in FIG. 1, the power supply circuit 5 and a megger-test switch 23 are arranged at the separate places of right and left sides of the zero-phase current transformer 3 in the spaces between the current transformer and the right and left side walls of the main housing 10. (The megger-test switch is manually operated in the dielectric strength test to disconnect the earth leakage detection circuit (an IC) 4 from the power supply circuit 5 and to trip the open-close mechanism thereby opening the main circuit contact.)

This application is based on, and claims priority to, Japanese Patent Application No. 2006-348358, filed on Dec. 25, 2006, the contents of which are incorporated herein by reference.

While the invention has been explained with reference to the specific embodiments of the invention, the explanation is illustrative and the invention is limited only by the appended claims.

What is claimed is:

1. A circuit breaker for overcurrent protection and earth leakage protection, comprising:

a zero-phase current transformer;

an earth leakage detection circuit;

a trip coil;

a sensitivity current-switch;

an action time switch;

an earth leakage test switch;

a circuit board having mounted thereon the earth leakage detection circuit, the sensitivity current-switch, the action time switch, and the earth leakage test switch;

an earth leakage trip unit case having installed therein the circuit board having thereon the earth leakage detection circuit, the sensitivity current-switch, the action time switch and the earth leakage test switch;

a main housing accommodating therein the earth leakage trip unit case, the zero-phase current transformer, and the trip coil; and an open-close operation handle, wherein the circuit board and the trip coil are combined, and the earth leakage trip unit case is disposed beside the open-close operation handle;

wherein the earth leakage trip unit case comprises:

a lower case accommodating the trip coil;

an upper case disposed on the lower case and accommodating the circuit board; and a cover disposed on the upper case, wherein terminals of the circuit board, an end of the upper case and an end of the cover are extended adjacent to the zero-phase current transformer, and terminals of the zero-phase current transformer and the terminals of the circuit board are electrically connected.

2. The circuit breaker according to claim 1, wherein the lower case, the upper case, and the cover are detachably engageable by a snap-fit mechanism.

3. The circuit breaker according to claim 1, further comprising lead wires drawn out of the terminals of the circuit board and connected to the zero-phase current transformer.

4. The circuit breaker according to claim 1, wherein the zero-phase current transformer is disposed adjacent to a load terminal of the main housing.

* * * * *